United States Patent [19]

Steindal

[11] Patent Number: 4,606,282

[45] Date of Patent: Aug. 19, 1986

[54] SELF FEEDING WOOD BURNING STOVE

[76] Inventor: Karl Steindal, 4870 North Douglas Hwy., Juneau, Ak. 99801

[21] Appl. No.: 806,296

[22] Filed: Dec. 9, 1985

[51] Int. Cl.[4] ..... F23K 3/16

[52] U.S. Cl. ..... 110/116; 110/118; 110/167; 110/293; 110/298; 126/73

[58] Field of Search ..... 110/254–257, 110/259, 267, 293, 298–302, 309, 310, 317–319, 116, 118, 166, 167; 126/68, 69, 73, 74, 83

[56] References Cited

U.S. PATENT DOCUMENTS

| | | | |
|---|---|---|---|
| 2,454,400 | 11/1948 | Norman | 110/293 X |
| 4,201,186 | 5/1980 | Paguin | 126/74 X |
| 4,321,879 | 3/1982 | Toivo | 110/267 |
| 4,355,587 | 10/1982 | Lemon | 110/293 |
| 4,530,289 | 7/1985 | Godbout | 110/254 X |

FOREIGN PATENT DOCUMENTS

| | | | |
|---|---|---|---|
| 2072831 | 10/1981 | United Kingdom | 110/267 |

*Primary Examiner*—Albert J. Makay
*Assistant Examiner*—Steven E. Warner
*Attorney, Agent, or Firm*—Christopher Duffy

[57] ABSTRACT

In the stove, pluralities of elongated logs are stacked on top of one another, substantially on parallels to a generally horizontal axis, to form a pair of sloping, single-log-wide, axially extending stacks of the same which are spaced apart but converge in the bottom of a sump at points above a slot in the vertical plane of the axis. Air is admitted to the sump through the slot, and a pair of spaced abutments is disposed upright in the plane of the axis at the sump, to engage between the opposing faces of the bottommost logs in the stacks and form an air flow channel therebetween above the slot. Moreover, a chamber is formed above the channel to confine the flames and the flow of combustion products from the channel to the space between the stacks of logs. The chamber in turn discharges the combustion products to a low pressure zone where they escape to atmosphere or the like.

20 Claims, 6 Drawing Figures

SELF FEEDING WOOD BURNING STOVE

DESCRIPTION

1. Technical Field

This invention relates to a self feeding wood burning stove, and in particular to one in which the logs are burned substantially on parallels to a generally horizontal axis.

2. Background Art

Self feeding wood burning stoves are known. See for example U.S. Pat. No. 4,355,587 wherein a pair of fuel feed conduits is filled with columns of logs that are stacked end to end of one another on inclined axes. Burning is effected at the bottom ends of the bottommost logs in the columns, and this fact severely limits the heat generating capacity of the stove, as well as the efficiency of the same. It also limits the horizontal area over which heat is generated since the logs are not used to best advantage in the stove. In fact, only a small percentage of each log undergoes burning at any point in time, e.g., one end portion of each bottommost log. Preferably, logs should be burned over the full length thereof so as to generate the maximum heat over the maximum area.

The present invention fulfills the need for a self feeding wood burning stove in which the logs are stacked on top of one another, substantially on parallels to a generally horizontal axis, and burned one by one over their full lengths at the bottom of the stack while the weight of the stack is employed to gravity feed the logs into the burning position. This arrangement makes it possible to increase the heat generating capacity of the stove, as well as its efficiency and the horizontal area over which the heat is generated. At the same time the invention fulfills the need for a stove of this nature in which the housing of the same is evenly heated by the burning action, and the flames and combustion products from the burning action are effectively controlled and prevented from reaching the remaining logs in the feed stack. The remaining logs are nevertheless predried by the burning action at the bottom of the stack, so that they are better prepared to be consumed when each takes its turn in the burning position.

DISCLOSURE OF INVENTION

According to the invention, the stove comprises an upright housing, the bottom portion of which defines a sump, the opposing side walls of which are symmetrically arrayed about a generally horizontal axis, substantially in parallel therewith, and slope downwardly toward the bottom line of the sump disposed in the vertical plane of said axis. There is an elongated slot formed in the bottom of the sump along the line of the plane, and certain substructure under the sump including means for feeding controlled amounts of air to the sump through the slot. There is also certain infrastructure in the housing including means defining a pair of spaced septa which depend within the sump on opposite sides of the axis, substantially in parallel therewith, and cooperate with the side walls of the sump in defining a pair of log-feed magazines in each of which a plurality of elongated logs can be stacked on top of one another substantially on parallels to the axis to form a pair of sloping, single-log-wide, axially extending stacks of the same which converge in the bottom of the sump at points above the slot adjacent the plane of the axis, there being a vertical gap at said points, between the bottoms of the septa and the bottom of the sump, in which the bottommost logs of the respective stacks can collect when the logs are stacked in the magazines. However, there are means in the gap defining a pair of spaced abutments which are disposed upright in the vertical plane of the axis so as to engage between the opposing faces of the bottommost logs and form an air flow channel therebetween above the slot when the bottommost logs collect at said points in the gap. Furthermore, there are means on the septa forming a chamber above the gap which opens into the channel between the bottommost logs above the slot to confine the flames and the flow of combustion products from the channel to the space between the septa when the opposing faces of the bottommost logs are ignited. There are also means connected with the chamber to discharge the combustion products from the same to a low pressure zone outside of the housing where the products can escape to atmosphere or the like.

Preferably, there are also means operable to form a pair of flame resistant skirts which depend from the septa athwart the paths of the bottommost logs in the stacks as they collect in the bottom of the sump at the aforesaid points in the gap, and means whereby the skirts are resiliently yieldable to the bottommost logs when the same engage the abutments in the gap, so that the opening of the chamber extends downwardly onto the tops of the bottommost logs to confine the flames and the combustion products to the gap between the magazines. The skirts may take the form of flaps which are hingedly connected to the bottoms of the septa and weighted to depend athwart the paths of the bottommost logs as they collect in the gap, but laterally displaceable toward one another by the tops of said logs when the same engage the abutments in the gap.

The substructure under the sump has certain preferred features. For example, the air feed means preferably include means defining a plurality of apertures which are spaced apart from one another in serial array along an inferior line extending in the plane of the axis below the aforementioned line of the slot in the bottom of the sump, means between the lines forming a corresponding series of caps over the apertures to shield them from ash falling through the slot, and air conduit means for conducting air to the individual apertures for discharge from the same below the caps. Preferably, the stove also includes means for varying the flow of air to the apertures in the air conduit means.

The aperture defining means may take the form of spaced parallel open ended pipe conduits which are arranged in serial array transverse the aforesaid lines and have apertures in the bottoms thereof along the inferior line, there being means for throttling the end openings of the conduits to vary the flow of air to the apertures therein.

The abutments may take the form of posts upstanding in the slot on a pair of the pipe conduits.

The stove preferably further comprises ignition means for igniting the opposing faces of the bottommost logs in the stacks. The ignition means may take the form of a first tray which is operably positionable below the slot in the bottom of the sump to carry an ignitable medium by which to ignite the faces of the bottommost logs and/or a second ignitable medium laterally interposed between the abutments and the faces of the respective bottommost logs on the bottom of the sump.

Preferably, the first tray is insertable and retractable to and from positions below the series of pipe conduits and outside of the stove, respectively.

Furthermore, the stove preferably comprises means for collecting ash which falls through the slot in the bottom of the sump. The ash collection means may take the form of a second tray which is insertable from a point outside of the stove, to a position below the slot in the bottom of the sump to collect the ash, and retractable from such position to such point for dumping, the first tray being temporarily removably suspendable on the second tray for insertion with the second tray to its position below the slot in the bottom of the sump, whereafter the opposing faces of the bottommost logs and/or the second ignitable medium therebetween, can be ignited, and the first tray can thereafter be retracted from such position by retraction of the second tray from its position below the slot, whereafter the first tray can be removed from the second tray before the latter is returned to its position below the slot.

The infrastructure in the housing also has certain preferred features. For example, in many presently preferred embodiments of the invention, the top portion of the housing provides a cover for the chamber. The combustion product discharge means include a flue at one axial end of the housing, and means defining a pair of elongated channels which extend axially of the chamber directly below the cover to feed the combustion product to the flue from the chamber. They also include means for admitting the combustion products to the channels from the chamber along the axial length of the chamber, and means for progressively diminishing the rate at which the combustion products are admitted to the channels from the chamber in the direction of the one axial end of the housing from the other. In certain presently preferred embodiments of the invention, the chamber forming means take the form of a rectangular box-like infrastructure that is longitudinally disposed on the axis of the sump and has an elongated axially extending slot in the bottom thereof which is adapted to extend above the channel between the opposing faces of the bottommost logs when they are engaged with the abutments. There is a pair of channel forming troughs on the side walls of the infrastructure, the opposing rims of which are spaced apart from the top of the infrastructure to form slots which admit the combustion products in the chamber to the channels of the trough. There is also a header box at the one axial end of the housing which interconnects the corresponding ends of the troughs with the flue. In some embodiments, the channels of the troughs incline relatively downwardly to the horizontal in the direction of the aforesaid one axial end of the housing, whereas the rims of the troughs incline relatively downwardly to the horizontal in the direction of the other axial end of the housing. In this way, the rate at which the combustion products are admitted to the channels of the troughs through the slots between the rims of the troughs and the top of the infrastructure, is progressively diminished in the direction of the one axial end of the housing from the other.

Preferably, the troughs are formed in the chamber itself.

Similarly, in many of the presently preferred embodiments of the invention, the septa defining means take the form of a box-like infrastructure that is disposed on the axis of the sump and defines the chamber between the axially extending side walls thereof. The side walls are adapted to cooperate with the side walls of the sump in defining the pair of log-feed magazines for the bottom of the sump.

Preferably, the sump is semicylindrical at the bottom thereof in these various embodiments.

BRIEF DESCRIPTION OF THE DRAWINGS

These features will be better understood by reference to the accompanying drawings which illustrate a presently preferred embodiment of the invention.

In the drawings.

BEST MODE FOR CARRYING OUT THE INVENTION

Figure 1:
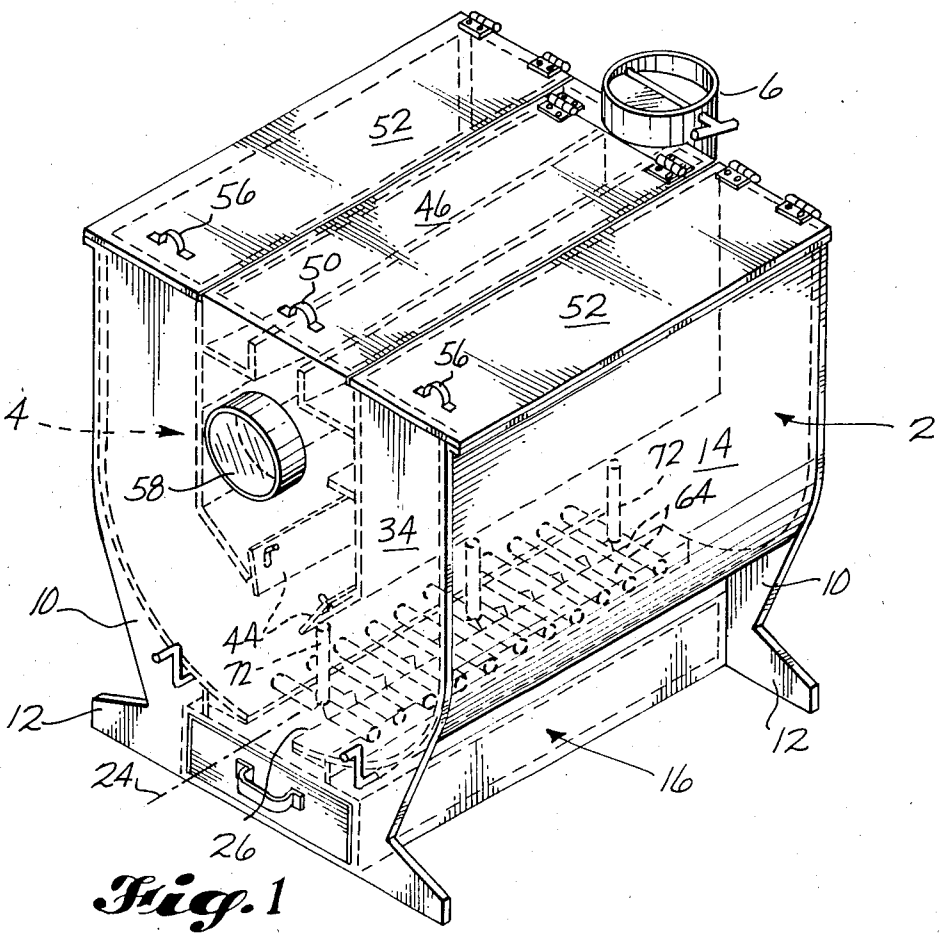
FIG. 1 is a perspective view of the wood burning stove with certain components of the infrastructure and substructure thereof shown in phantom.

Referring to the drawings, it will be seen that the stove comprises an elongated cradle-like housing 2 which is interiorly subdivided by certain infrastructure 4 and serviced by a flue 6 at the rear end thereof and an ash box 8 at the bottom thereof. The housing 2 comprises a pair of end walls 10 which have laterally projecting feet 12 thereon, and are joined by an intermediate center section 14 which is trough-like in cross-section and supported on a pedestal-like base 16. The bottom portion of the center section defines a semicylindrical sump 16, the opposing side walls 20 of which are symmetrically arrayed about a generally horizontal axis 22, substantially in parallel therewith, and slope downwardly toward the bottom line 24 of the sump disposed in the vertical plane of the axis. An elongated slot 26 is formed in the bottom of the sump along the line 24 of the plane, and the base 16 has a duct assembly 28 in the neck 29 thereof which feeds controlled amounts of air to the sump through the slot 26, as shall be explained. The air supports combustion in the bottom of the sump and the combustion products are captured between a pair of septa-like curtain walls 34 which depend from the top of the housing between the end walls 10 thereof, and are symmetrically spaced about the axis of the sump to define an open-throated chamber 32 above the slot 26. In addition, the walls 34 are canted inwardly toward the vertical plane of the axis 22 at the bottom, and are adapted to approach the combustion site so that the flames from the same are confined to the throat 30 of the chamber. Meanwhile, the products of combustion are discharged to atmosphere through the flue 6, as shall be explained.

The walls 34 also cooperate with the side walls 20 of the sump in defining a pair of log-feed magazines 36 in which pluralities of elongated logs 40 can be stacked on top of one another, substantially on parallels to the axis 22, to form a pair of sloping, single-log-wide axially extending stacks of the same which converge in the bottom of the sump 18 at points above the slot 26 adjacent the plane of the axis 22. The walls 34 terminate well above the bottom of the sump, however, to leave a vertical gap 38 between the throat 30 of the chamber 32 and the slot 26 at the bottom of the sump. The gap 38 is adapted so that the bottommost logs 40' of the respective stacks can collect in the bottom of the sump when the logs are stacked in magazines 36. However, there are three spaced abutments 72 in the gap which are disposed upright in the vertical plane of the axis 22 so as to engage between the mutually opposing faces 42 of the bottommost logs 40' and form an air flow channel 108 therebetween above the slot 26 when the bottommost logs collect in the gap 38. In this way, the mutually opposing faces 42 of the bottommost logs 40' can be ignited in a manner to be explained, and while the facial portions of the bottommost logs are consumed by fire, the flames from the same will be confined to the channel 108 and the throat 30 of the chamber 32, and the combustion products will be captured in the chamber and discharged into the flue 6, as mentioned earlier.

Preferably, the stove also includes a pair of flame resistant flaps 44 which are hingedly connected to the bottoms of the curtain walls 34 and weighted to depend athwart the paths of the bottommost logs 40' as they collect in the gap 38, but at the same time, be laterally displaceable toward one another by the tops of the logs when the same engage the abutments 72 in the gap. In this way, the flaps 44 form a pair of flame resistant skirts which are resiliently yieldable to the bottommost logs as indicated, but extend the opening 30 of the chamber downwardly onto the tops of the bottommost logs to confine the flames and the combustion products to the gap between the magazines 36.

If desired, the top of the chamber may be permanently closed and the chamber itself may be serviced from either or both ends. Or the top may be closed by a lid 46 which is hinged at the rear and seated on flanges 48 so that it can be raised by a handle 50 at the proximal end thereof. Similarly, the magazines 36 may be permanently closed at the top and loaded at the sides of the housing; but preferably are top loaded through hinged lids 52 on the top thereof which rest again on flanges 54 and are equipped with handles 56 at the proximal ends thereof.

Figure 3:
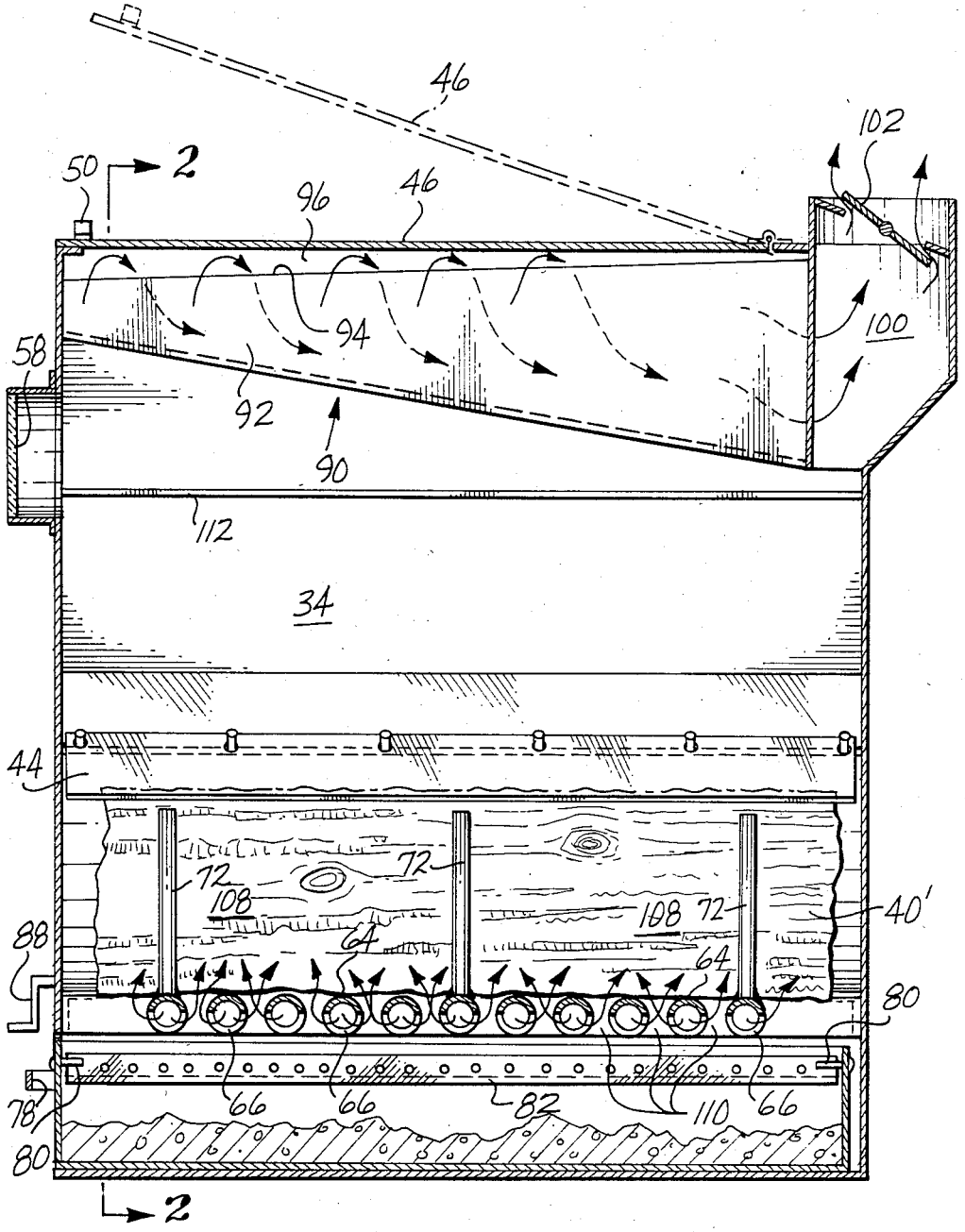
FIG. 3 is a cross-sectional view of the wood burning stove along the line 3—3 of FIG. 2.
Figure 4:
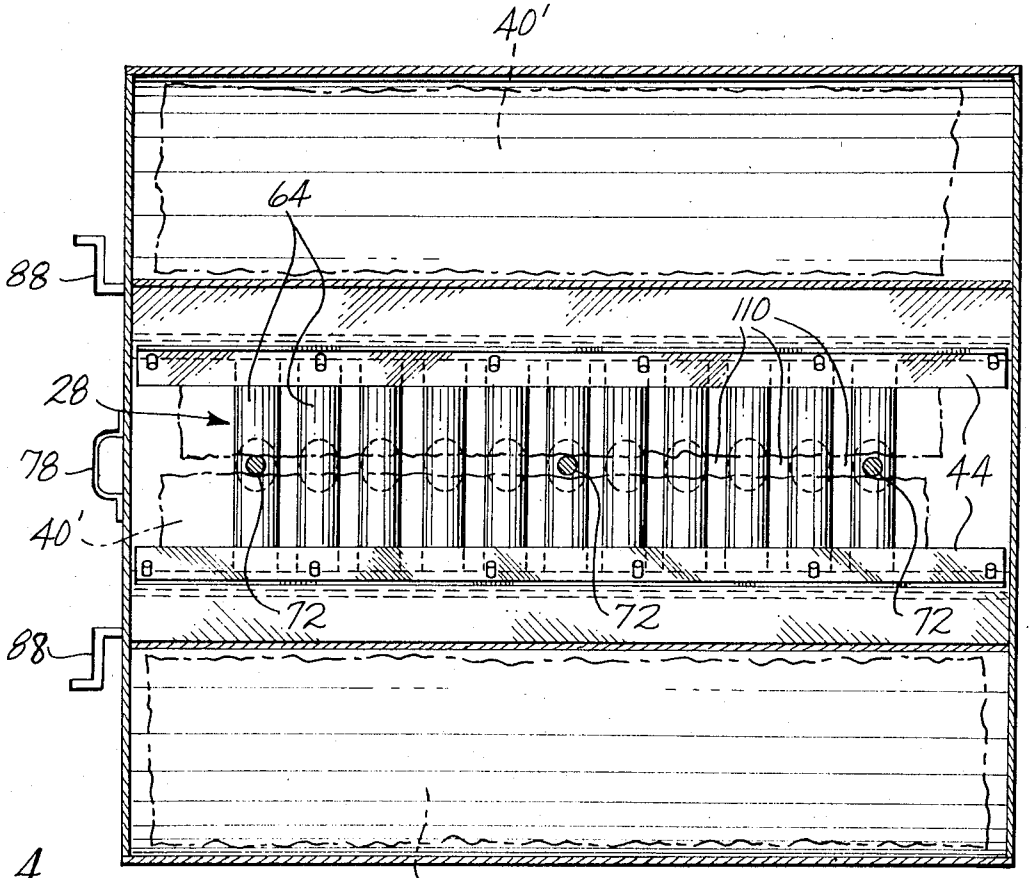
FIG. 4 is a cross-sectional view of the wood burning stove along the line 4—4 of FIG. 2.

The chamber may also have a viewing port 58, as seen in FIGS. 1 and 3.

Referring now to the duct assembly 28 in particular, it will be seen that the opposing sides 60 of the neck 29 of the base 16 of the housing have series of uniformly spaced holes 62 therein which are mutually opposed to one another across the mouth of the neck. The series of holes 62 are interconnected by a corresponding series of spaced, parallel, open ended pipe conduits 64 which extend in serial array transverse the slot 26 in the bottom of the sump. The conduits 64 have V-notched apertures 66 in the bottoms thereof along an inferior line below the line 24 of the slot 26 in the vertical plane of the axis 22, and there is a pair of slide mechanisms 68 on the shoulders 70 of the base 16 for throttling the end openings 62 of the conduits to control the flow of air to the apertures 66 therein. In addition, three of the conduits haves posts 72 upstanding thereon in the slot to perform as the abutments mentioned earlier. The posts 72 project to a height well within the gap 38 between the slot 26 and the throat 30 of the chamber, and are spaced apart from one another in the gap 38 to form the abutments for the bottommost logs 40' in the magazines 36 as indicated.

Figure 2:
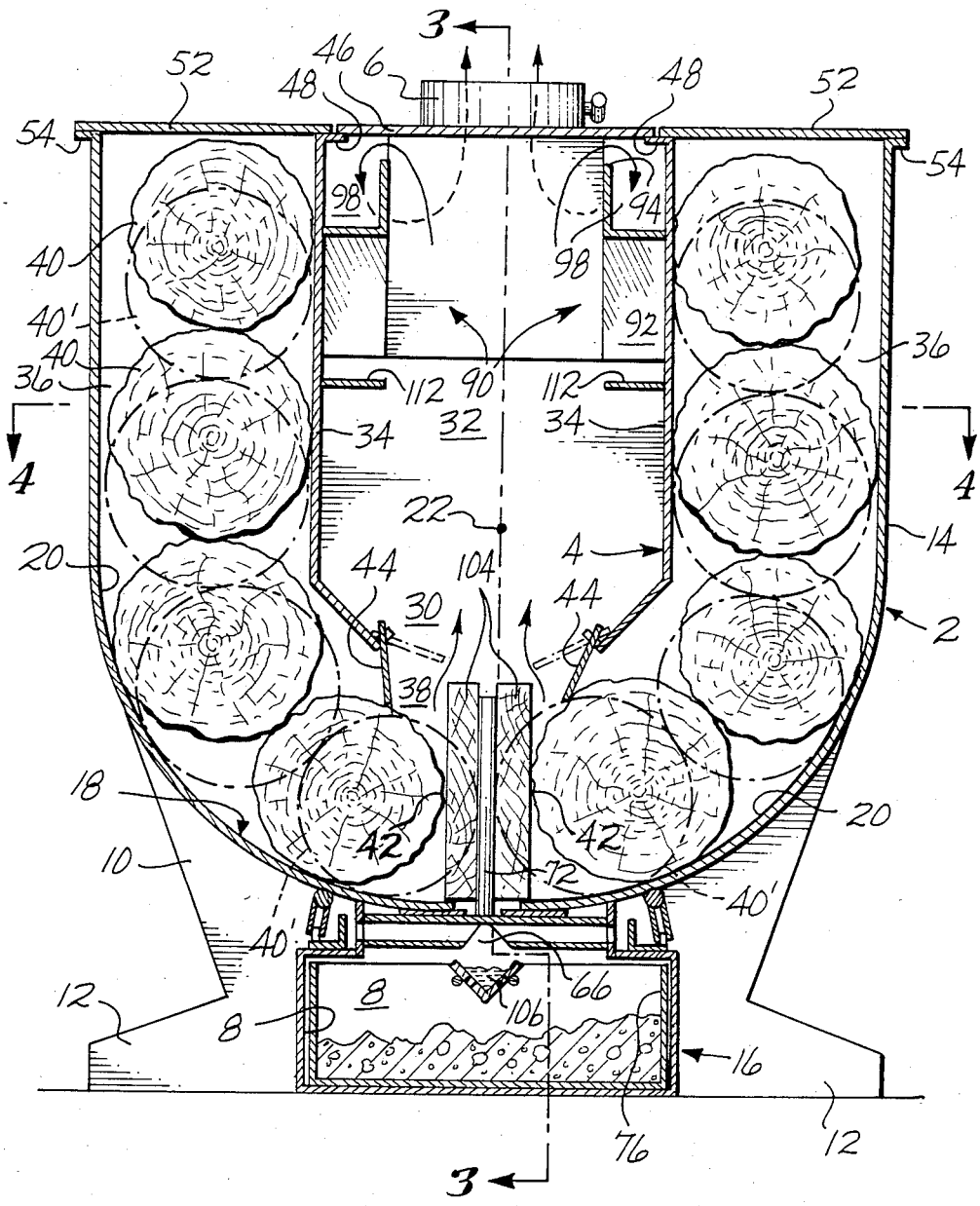
FIG. 2 is a cross-sectional view of the wood burning stove along the line 2—2 of FIG. 3.
Figures 5, 6:
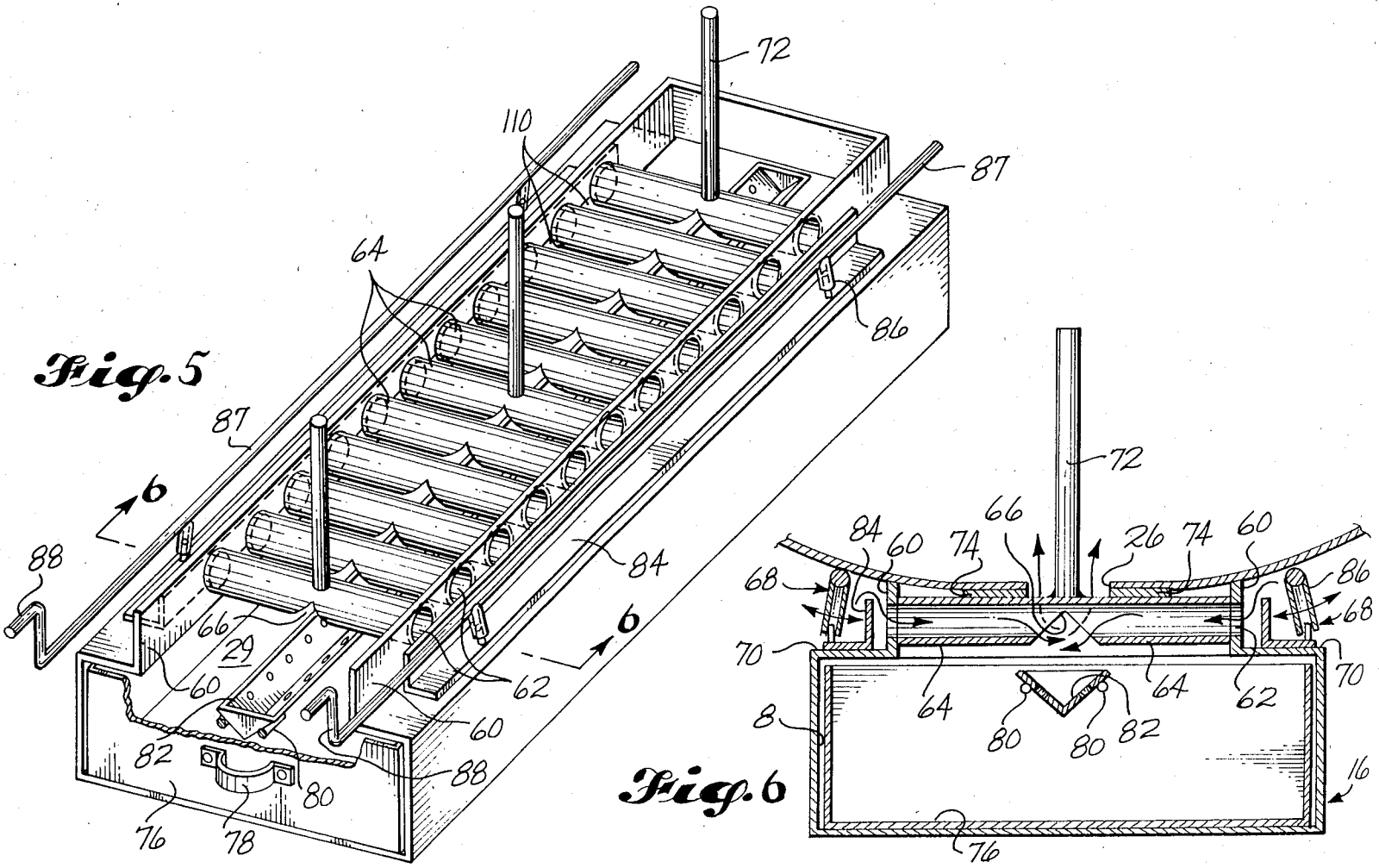
FIG. 5 is an exploded perspective view of the substructure of the stove under the sump.
FIG. 6 is a cross-sectional view of the substructure along the line 6—6 of FIG. 5.

Optionally, a pair of flat barstock 74 may be secured to the underside of the center section 14, to each side of the slot 26, as a means of rigidifying the substructure comprising the assembly 28. Moreover, if desired, the barstock 74 can be slidably mounted between the conduits 64 and the bottom of the center section 14, to control the width of the slot 26, as shown by a comparison of FIGS. 2 and 6.

The ash box 8 is housed in the base 16 and is coextensive with the slot 26 in the sump of the housing. Slidably insertable in the box 8 from the proximal end of the stove is an ash drawer 76 having a handle 78 on its proximal end. The drawer 76 also has pairs of pin supports 80 therein which project from the opposing axial ends thereof. These supports 80 provide seats for a perforated, triangularly cross-sectioned ignition tray 82 which is temporarily suspended in the box 8 for purposes of igniting the stove through the slot 26, as shall be explained.

The slide mechanisms 68 comprise right angular plates 84 which are slidably mounted on the shoulders 70 of the base 16; and are accompanied by a pair of pin and tube cranks 86 which are pivotally suspended on crank rods 87 from the bottom of the center section 14 of the housing to enable the plates 84 to be shifted in relation to the open ends 62 of the conduits 64 by turning the handles 88 of the rods 87 at the proximal end of the stove.

Inside the top of the chamber 32 there is additional infrastructure 90 for discharging the products of combustion from the site of the same in the gap 38 of the sump, as indicated earlier. This structure 90 includes a pair of channel-forming troughs 92 on the inside walls 34 of the chamber, the opposing rims 94 of which are spaced apart from the top 46 of the chamber to form slots 96 which admit the gases in the chamber to the channels 98 of the troughs 92. The structure also includes a header box 100 which interconnects the distal ends of the troughs 92 with the flue 6 at the distal end of the chamber. The channels 98 of the troughs are inclined downwardly to the horizontal in the direction of the header box 100, while the rims 94 of the troughs are inclined downwardly to the horizontal in the direction of the proximal end wall 10 of the housing. In this way, the combustion products in the chamber 32 are induced to flow more rapidly into the channels 98 of the troughs at the proximal ends of the channels, than at the distal ends thereof, but still exhaust rapidly into the header box 100 at the distal ends of the channels. As a result, the top 46 of the chamber is exposed for a longer time to the heat of the exhaust, and moreover, is exposed to the exhaust over the full length of the chamber.

The flow through the flue 6 is controlled in conventional fashion by a damper 102.

When the stove is loaded for use, initially two board-like pieces of kindling wood 104 are placed on edge in the bottom of the sump to either side of the posts 72. The logs 40 are then stacked in the magazines 36 against the wood, and an ignitable material 106, such as oil soaked sawdust, is placed in the ignition tray 82. The tray is then rested on the pin seats 80 for the same at the ends of the ash drawer 76, the material 106 is ignited, and the drawer is inserted in the ash box 8 of the base 16. The fire in the ignition tray 82 attacks the opposing faces of the kindling wood 104, while at the same time subjecting the duct assembly 28 to heat so that suction is created in the conduits 64 and the slot 26 thereabove. The suction generates an updraft through the channel 108 between the pieces 104 of kindling wood, in the spaces between the pairs of posts 72, and the flames from the tray 82 are thus drawn up even more forcefully into the channel to ignite the opposing faces of the wood. As the pieces of wood burn, they in turn ignite the opposing faces 42 of the bottommost logs 40'; and these logs then undergo burning at the facial portions thereof while the stacks of logs in the magazines 36 thereabove are protected from burning by the flaps 44 of the chamber and by the bottommost logs 40' themselves. The flaps also confine the flames and the flow of combustion products to the throat 30 of the chamber, aided in part by the bellows effect at the slot 26. Meanwhile, the combustion products exhaust into the header box 100, and then out the flue 6, while playing over the top 46 of the chamber to radiate the most heat from the stove. Ultimately, the bottommost logs 40' are themselves consumed, and as they turn into ash, the ash gravitates through the spaces 110 between the pipe conduits 64 and collects in the ash drawer 76, from whence it is removed from time to time. Moreover, the remaining logs 40 gravitate into still lower positions, and each time the bottommost are consumed, a new pair takes their place, until ultimately all are consumed.

Preferably, each time it is used, the ignition tray 82 is removed from the drawer 76 after the kindling wood 104 have been ignited. The drawer is then returned to the base. Also, the infrastructure 4 preferably includes stiffener ribs 112 on the curtain walls 34 thereof, below the troughs 92; and the housing is made air tight at the seams between the lids 46 and 52 and the flanges 48 and 54, respectively, by equipping each of the lids 46 and 52 with a narrow bead (not shown) around the inside edge thereof and seating the bead in a shallow bed of fine sand (not shown) formed on the respective flanges 48 and 54.

I claim:

1. A wood burning stove comprising:

an upright housing, the bottom portion of which defines a sump, the opposing side walls of which are symmetrically arrayed about a generally horizontal axis, substantially in parallel therewith, and slope downwardly toward the bottom line of the sump disposed in the vertical plane of said axis, there being an elongated slot formed in the bottom of the sump along the line of the plane, and means under the sump for feeding controlled amounts of air to the sump through the slot, means in the housing defining a pair of spaced septa which depend within the sump on opposite sides of the axis, substantially in parallel therewith, and cooperate with the sidewalls of the sump in defining a pair of log feed magazines in each of which a plurality of elongated logs can be stacked on top of one another substantially on parallels to the axis to form a pair of sloping, single-log-wide, axially extending stacks of the same which converge in the bottom of the sump at points above the slot adjacent the plane of the axis, there being a vertical gap at said points between the bottoms of the septa and the bottom of the sump, in which the bottommost logs of the respective stacks can collect when the logs are stacked in the magazines, means in the gap defining a pair of spaced abutments which are disposed upright in the vertical plane of the axis so as to engage between the opposing faces of the bottommost logs and form an air flow channel therebetween above the slot when the bottommost logs collect at said points in the gap, means on the septa forming a chamber above the gap which opens into the channel between the bottommost logs above the slot to confine the flames and the flow of combustion products from the channel to the space between the septa when the opposing faces of the bottommost logs are ignited, and means connected with the chamber to discharge the combustion products from the same to a low pressure zone outside of the housing where the products can escape to atmosphere or the like.

2. The wood burning stove according to claim 1 wherein the air feed means include spaced parallel pipe conduits which are arranged in serial array transverse the aforesaid line of the slot in the bottom of the sump, and have apertures in the bodies thereof along an inferior line extending in the plane of the axis below said line, there being a pair of posts upstanding in the slot on a pair of the pipe conduits to form the abutments.

3. The wood burning stove according to claim 1 further comprising means for collecting ash which falls through the slot in the bottom of the sump.

4. The wood burning stove according to claim 1 further comprising a first tray for insertion below the slot in the bottom of the sump to carry an ignitable medium by which to ignite the faces of the bottommost logs and/or a second ignitable medium laterally interposed between the abutments and the faces of the respective bottommost logs on the bottom of the sump, and a second tray which is insertable from a point outside of the stove, to a position below the slot in the bottom of the sump to collect the ash which falls through the slot, and retractable from such position to such point for dumping, the first tray being temporarily removably suspendable on the second tray for insertion with the second tray to its position below the slot in the bottom of the sump, whereafter the opposing faces of the bottommost logs and/or the second ignitable medium therebetween, can be ignited, and the first tray can thereafter be retracted from such position by retraction of the second tray from its position below the slot, whereafter the first tray can be removed from the second tray before the latter is returned to its position below the slot.

5. The wood burning stove according to claim 1 wherein the septa defining means take the form of a box-like infrastructure that is disposed on the axis of the sump and defines the chamber between the axially extending side walls thereof, the side walls being adapted to cooperate with the side walls of the sump in defining the pair of log feed magazines for the bottom of the sump.

6. The wood burning stove according to claim 1 wherein the sump is semicylindrical at the bottom thereof.

7. The wood burning stove according to claim 1 further comprising means operable to form a pair of flame resistant skirts which depend from the septa thwart the paths of the bottommost logs in the stacks as they collect in the bottom of the sump at the aforesaid points in the gap, and means whereby the skirts are resiliently yieldable to the bottommost logs when the same engage the abutments in the gap, so that the opening of the chamber extends downwardly onto the tops of the bottommost logs to confine the flames and the combustion products to the gap between the magazines.

8. The wood burning stove according to claim 7 wherein the skirts take the form of flaps which are hingedly connected to the bottoms of the septa and weighted to depend athwart the paths of the bottommost logs as they collect in the gap, but laterally displaceable toward one another by the tops of said logs when the same engage the abutments in the gap.

9. The wood burning stove according to claim 1 wherein the air feed means include means defining a plurality of apertures which are spaced apart from one another in serial array along an inferior line extending in the plane of the axis below the aforementioned line of the slot in the bottom of the sump, means between the lines forming a corresponding series of caps over the apertures to shield them from ash falling through the slot, and air conduit means for conducting air to the individual apertures for discharge from the same below the caps.

10. The wood burning stove according to claim 9 further comprising means for varying the flow of air to the apertures in the air conduit means.

11. The wood burning stove according to claim 9 wherein the aperture defining means take the form of spaced parallel open ended pipe conduits which are arranged in serial array transverse the aforesaid lines and have apertures in the bottoms thereof along the inferior line.

12. The wood burning stove according to claim 11 further comprising means for throttling the end openings of the conduits to vary the flow of air to the apertures therein.

13. The wood burning stove according to claim 11 wherein the abutments take the form of posts upstanding in the slot on a pair of the pipe conduits.

14. The wood burning stove according to claim 1 further comprising ignition means for igniting the opposing faces of the bottommost logs in the stacks.

15. The wood burning stove acccording to claim 14 wherein the ignition means take the form of a first tray which is operably positionable below the slot in the bottom of the sump to carry an ignitable medium by which to ignite the faces of the bottommost logs and/or a second ignitable means laterally interposed between the abutments and the faces of the respective bottommost logs on the bottom of the sump.

16. The wood burning stove according to claim 15 wherein the air feed means include spaced parallel pipe conduits which are arranged in serial array transverse the aforesaid line of the slot in the bottom of the sump and the first tray is insertable and retractable to and from positions below the series of pipe conduits and outside of the stove, respectively.

17. The wood burning stove according to claim 1 wherein the top portion of the housing provides a cover for the chamber, and the combustion product discharge means include a flue at one axial end of the housing, means defining a pair of elongated channels which extend axially of the chamber directly below the cover to feed the combustion products to the flue from the chamber, means for admitting the combustion products to the channels from the chamber along the axial length of the chamber, and means for progressively diminishing the rate at which the combustion products are admitted to the channels from the chamber in the direction of the one axial end of the housing from the other.

18. The wood burning stove according to claim 17 wherein the chamber forming means take the form of a rectangularly-shaped box-like infrastructure that is longitudinally disposed on the axis of the sump and has an elongated axially extending slot in the bottom thereof which is adapted to extend above the channel between the opposing faces of the bottommost logs when they are engaged with the abutments, there being a pair of channel forming troughs on the side walls of the infrastructure, the opposing rims of which are spaced apart from the top of the infrastructure to form slots which admit the combustion products in the chamber to the channels of the troughs, and a header box at one axial end of the housing which interconnects the corresponding ends of the troughs with the flue.

19. The wood burning stove according to claim 18 wherein the channels of the troughs incline relatively downwardly to the horizontal in the direction of the aforesaid one axial end of the housing, and the rims of the troughs incline relatively downwardly to the horizontal in the direction of the other axial end of the housing, so as to progressively diminish the rate at which the combustion products are admitted to the channels of the troughs through the slots between the rims of the troughs and the top of the infrastructure in the direction of the one axial end of the housing from the other.

20. The wood burning stove according to claim 18 wherein the troughs are formed in the chamber.

* * * * *